US008371664B1

(12) United States Patent
Chen

(10) Patent No.: US 8,371,664 B1
(45) Date of Patent: Feb. 12, 2013

(54) INTERLOCKING DEVICE FOR A DRAWER SLIDE

(75) Inventor: Shih-Wang Chen, Taipei (TW)

(73) Assignee: Sun Chain Metal Industry Co., Ltd., Taipei (TW)

( * ) Notice: Subject to any disclaimer, the term of this patent is extended or adjusted under 35 U.S.C. 154(b) by 0 days.

(21) Appl. No.: 13/352,284

(22) Filed: Jan. 17, 2012

(30) Foreign Application Priority Data

Jul. 21, 2011 (TW) ..... 100125740

(51) Int. Cl.
*E05B 65/46* (2006.01)

(52) U.S. Cl. ..... 312/221; 312/218

(58) Field of Classification Search ..... 312/215, 312/216, 217, 218, 219, 220, 221, 222
See application file for complete search history.

(56) References Cited

U.S. PATENT DOCUMENTS 683,852 A * 10/1901 Ferry et al. ..... 312/107.5
2,240,067 A * 4/1941 Bolesky et al. ..... 312/221
5,352,030 A * 10/1994 Derle et al. ..... 312/221
6,186,606 B1 * 2/2001 Krei ..... 312/221
6,296,332 B1 * 10/2001 Lammens ..... 312/217
7,520,576 B2 * 4/2009 Ludwig et al. ..... 312/221
7,775,612 B2 * 8/2010 Ruan et al. ..... 312/221
2003/0141790 A1 * 7/2003 Weng ..... 312/217

* cited by examiner

*Primary Examiner* — Darnell Jayne
*Assistant Examiner* — Mart K Kuhn

(57) ABSTRACT

An interlocking device for a drawer slide is provided with an outer board, a fixed seat, two linkage members, a middle board, a restricting member and an inner board. When one of the drawers in a cabinet is pulled toward the first end of the outer board, the inner board will be moved together with the drawer and push the restricting member, the middle board and the actuating block, then the two linkage members are pushed to move in an opposite direction to the Y direction, the two connecting rod are caused to push the linkage members of other interlocking devices, so that the inclined surface of the guiding portion of one of the linkage members of other interlocking devices will be received in the receiving space and abutted against the inclined guiding surface of the actuating block of the middle board to prevent other drawers from being pulled out.

8 Claims, 11 Drawing Sheets

INTERLOCKING DEVICE FOR A DRAWER SLIDE

BACKGROUND OF THE INVENTION

1. Field of the Invention

The present invention relates to a drawer slide, and more particularly to an interlocking device capable of providing strong structure strength to the linkage member and maintaining other drawers in a locked state when one drawer is being pulled. Furthermore, since the middle board is driven to slide by the inner board.

2. Description of the Prior Art

Cabinets are normally provided with an interlocking device as shown in FIGS. 11-13 in order to prevent other drawers from being opened when one of the drawers is pulled out. The conventional interlocking device comprises an outer board 90 which is formed with an elongated groove 901 and an assembling hole 902 at an end thereof. A clipping piece 91 is disposed in the elongated groove 901 and includes an extending clipping portion 911 which defines a space 912 with respect to the assembling hole 902. The interlocking device further comprises two linkage members 93, each of which includes an L-shaped abutting portion 931, an engaging protrusion 932 and an assembling portion 933. The abutting portions 931 are disposed in the space 912, and the engaging protrusion 932 are inserted into the elongated groove 901 from the assembling hole 902 and restricted therein by the lateral edge of the elongated groove 901. The assembling portions 933 are provided for insertion of linkage rod (now shown) to engage with or move other structures.

As shown in FIGS. 12 and 13, in the outer board 90 are disposed a middle board 94 and an inner board 95. The outer board 90 is disposed in the cabinet, and the inner board 95 is disposed in the drawers. FIG. 12 shows that the inner board 95 is provided at its end close to the linkage members 93 with an actuator 96. The actuator is rhombic-shaped and includes two oblique surfaces 961 tapering toward the inner board 95 and two oblique surface 962 tapering in an opposite direction to the tapering direction of the oblique surfaces 961. The engaging protrusions 932 of the linkage members 93 are each provided with an oblique surface 9321, 9322, and the oblique surfaces 9321, 9322 are tapered in opposite directions.

The four oblique surfaces 961, 962 of the actuator 96 and the oblique surfaces 9321, 9322 of the engaging protrusions 932 of the linkage members 93 cooperate with one another to make the inner board 95 push against the two linkage members 93 when the inner board 95 moves along the with the drawers. However, the upper linkage member 93 as shown in FIG. 12 will fall off and abut against the edge of the inner board 95 after the actuator 96 passes, so that the engaging protrusions 932 of the two linkage members 93 won't be able to abut against the edge of the outer board 90 to move the linkage rod (not shown) and other structures.

To solve the abovementioned problem, another conventional structure was invented as shown in FIG. 13, wherein the actuator 97 is located at one end of the middle board 94 close to the linkage members 93 and extends toward the linkage members 93 to form two swayable clipping arms 971. When the inner board 95 moves through the two clipping arms 971, it will push the two clipping arms 971 toward the two linkage members 93, so as to make the engaging protrusions 932 of the linkage members 93 press against the edge of the outer board 90, so that the linkage rod (not shown) is able to move and engage with other structures.

However, as shown in FIG. 13, the actuator 97 and the clipping arms 971 are integral with each other as an elastic unitary structure made of plastic material, the actuator 97 has a weak structural strength, and the clipping arms 971 are more likely to be broken due to frequent sway motion. Furthermore, the linkage members 93 are positioned by the engaging protrusions 932 pressing against the edge of the outer board 90, however, the engaging protrusions 932 are small and thin to be strong enough to stand the pressing force applied to the edge of the outer board 90 by the actuators 96, 97. The present invention has arisen to mitigate and/or obviate the aforedescribed disadvantages.

SUMMARY OF THE INVENTION

The primary object of the present invention is to provide an interlocking device capable of providing strong structure strength to the linkage member and maintaining other drawers in a locked state when one drawer is being pulled. Furthermore, since the middle board is driven to slide by the inner board, when the drawer is being closed, the middle board and the inner board can be pushed back synchronously, reducing the noise caused when the drawer slide is returning.

To achieve the above object, an interlocking device in accordance with the present invention comprises an elongated outer board, a fixed seat, two linkage members, a middle board, a restricting member and an inner board.

The elongated outer board is fixed in the cabinet and including a first end, a second end and an elongated groove connected between the first and second ends, a direction from the first end to the second end is defined as an X direction, and a Y direction being perpendicular to the X direction, the outer board is provided with an assembling portion at the first end.

The fixed seat is disposed at the assembling portion of the outer board and formed at both ends thereof with two receiving portions and a connecting portion between the two receiving portions, each of the receiving portions being formed with an assembling notch extending in the Y direction, the connecting portion is provided at both sides thereof with two rib portions extending in the Y direction, and a receiving space is defined between the two rib portions and in communication with the two assembling notches.

The two linkage members each are provided with a pushing portion, a guiding portion and an assembling portion that are arranged in a stepped manner that the guiding portion is lower than the assembling portion and higher than the pushing portion. At an end of the pushing portion of the respective linkage members is formed a pushing edge. The guiding portion includes an inclined surface which is perpendicular and adjacent to the pushing portion. The assembling portion is formed with a groove, the pushing portion and the guiding portion of the two linkage members are inserted into the fixed seat via the assembling notches of the two receiving portions of the fixed seat in such a manner that a distance between the two inclined surfaces of the two linkage members tapers toward the first end of the outer board. The pushing edges of the two linkage members are abutted against each other in such a manner that one of the linkage members has the inclined surface of its guiding portion received in the receiving space, so as to make the assembling portion of the other linkage member disengage from its corresponding assembling notch, the inclined surface of the guiding portion of the other linkage member is received in the corresponding assembling notch.

The elongated middle board is received in the elongated groove of the outer board and formed with an elongated groove extending in the X direction and two lateral edges at both sides of the elongated groove. The middle board is provided at one end thereof with an actuating block located corresponding to the first end of the outer board, at one end of the actuating block are formed two inclined guiding surfaces, and the distance between the two inclined guiding surfaces tapers toward the first end of the outer board. The actuating block is provided with a pivot portion located adjacent to one of the lateral edges of the elongated groove, and the actuating block of the middle board is disposed between the two receiving portions of the fixed seat. A height of the two inclined guiding surfaces is equal to that of the inclined surfaces of the two guiding portions of the linkage members, and a distance between the inclined surfaces of the two linkage members is bigger than a distance between the two inclined guiding surfaces of the actuating block.

The restricting member is formed around its periphery with a stopping surface, a restricting surface adjacent to the stopping surface and a pivot portion at a conjunction between the stopping surface and the restricting surface. The pivot portion of the restricting member is pivoted to the pivot portion of the actuating block of the middle board in such a manner that the restricting surface is stopped against one of the receiving portions of the fixed seat.

The elongated inner board is received in the elongated groove of the middle board and then fixed to a drawer of the cabinet, the inner board is formed with a notch in the shape of the restricting member and includes a pushing surface for pushing against the stopping surface of the restricting member.

The respective connecting rods have two ends inserted and connected to the grooves of the linkage members and are arranged in the Y direction. The drawers are arranged in the Y direction. When one of the drawers is pulled in the X direction toward the first end of the outer board, the inner board will be moved together with the drawer being pulled and push the restricting member, the middle board and the actuating block, then the two linkage members are pushed to move in an opposite direction to the Y direction, as a result, the connecting rods are caused to push the linkage members of other interlocking devices, so that the inclined surface of the guiding portion of one of the linkage members of other interlocking devices will be received in the receiving space and abutted against the inclined guiding surface of the actuating block of the middle board of the other interlocking devices to prevent other drawers from being pulled out.

DETAILED DESCRIPTION OF THE PREFERRED EMBODIMENTS

Figure 1:
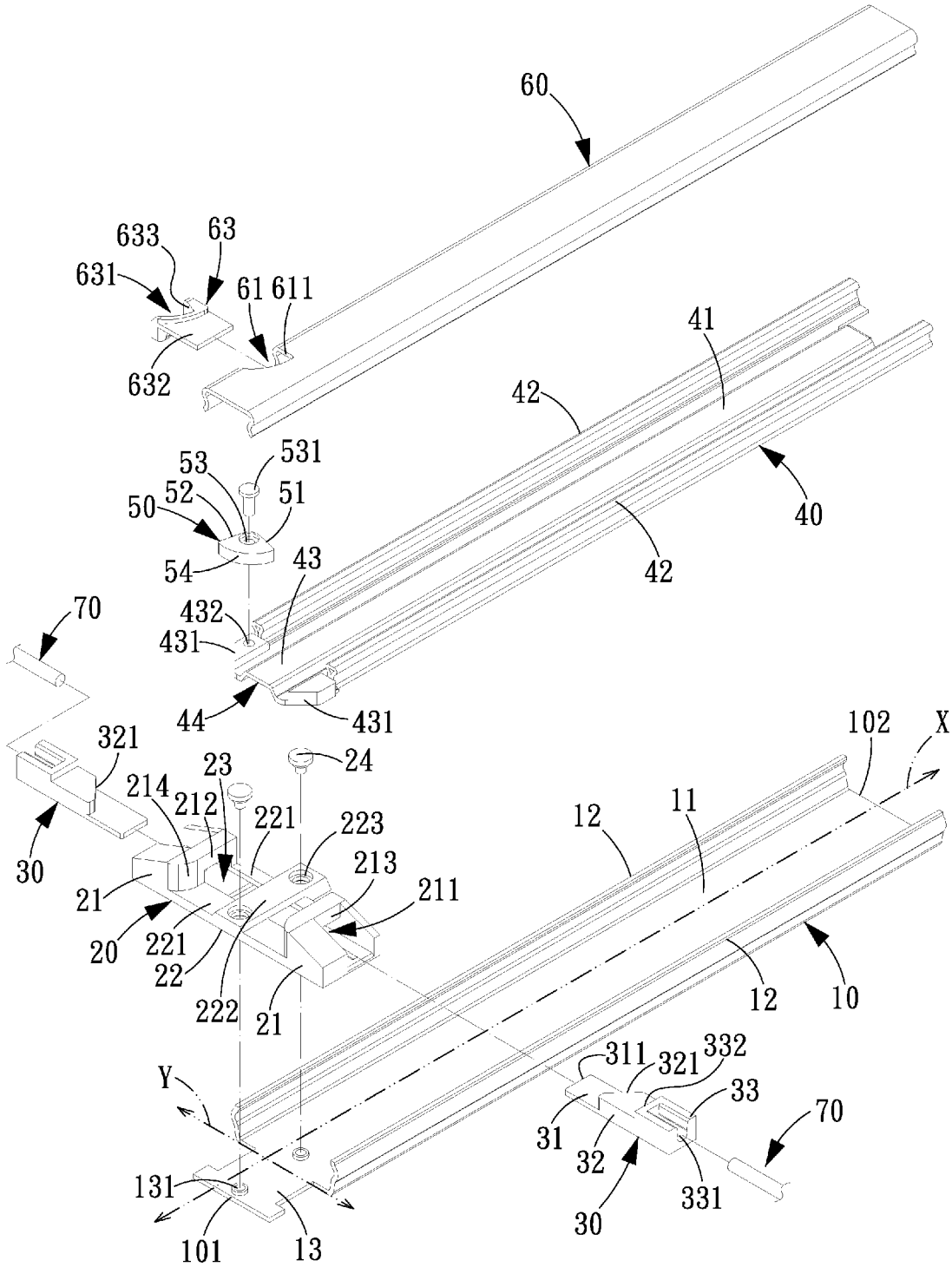
FIG. 1 is an exploded view of an interlocking device for a drawer slide in accordance with a first embodiment of the present invention.
Figure 2:
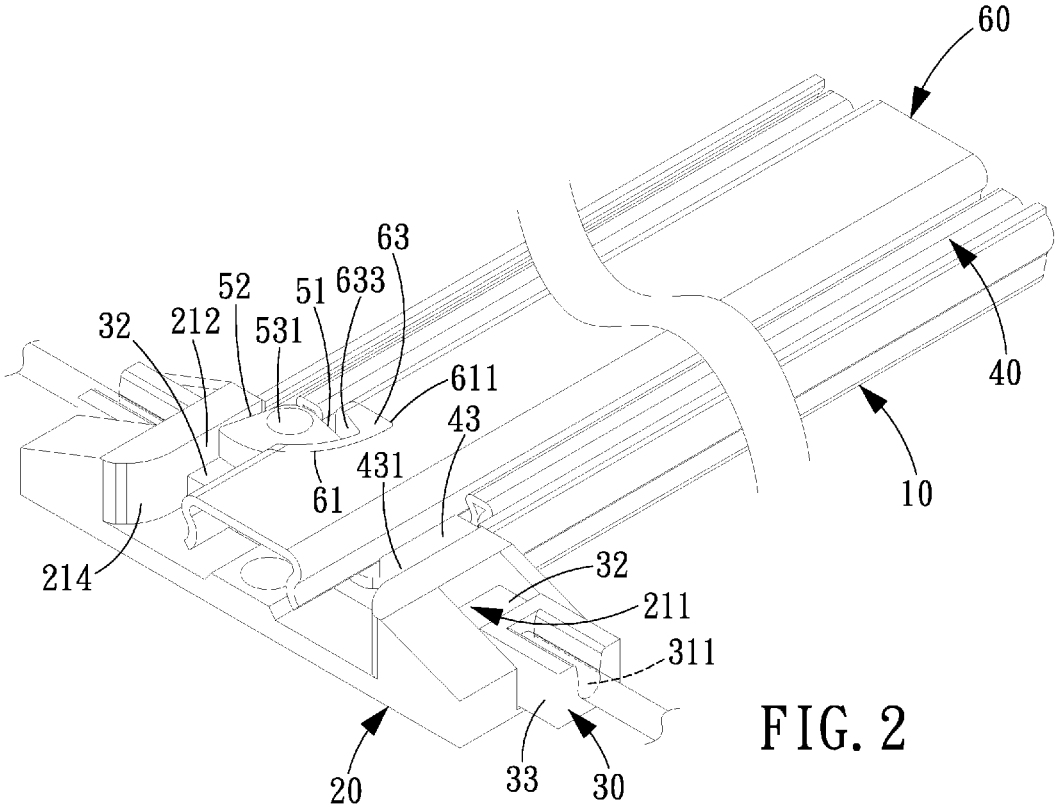
FIG. 2 is an assembly view of the interlocking device for a drawer slide in accordance with the first embodiment of the present invention.
Figure 3:
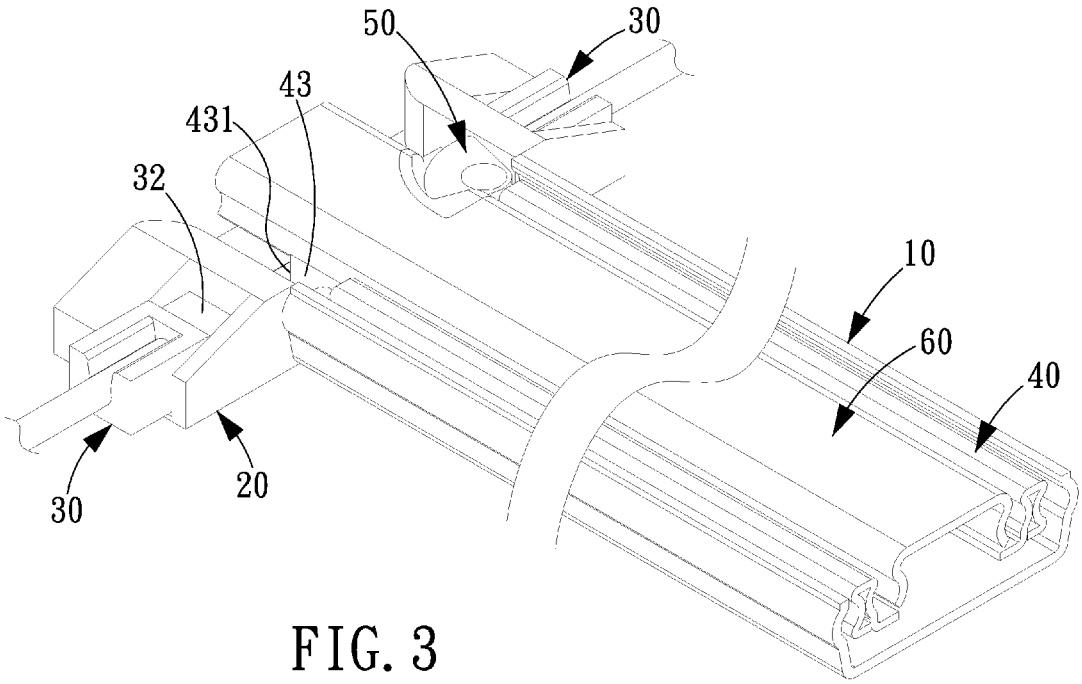
FIG. 3 is another assembly view of the interlocking device for a drawer slide in accordance with the first embodiment of the present invention.
Figure 4:
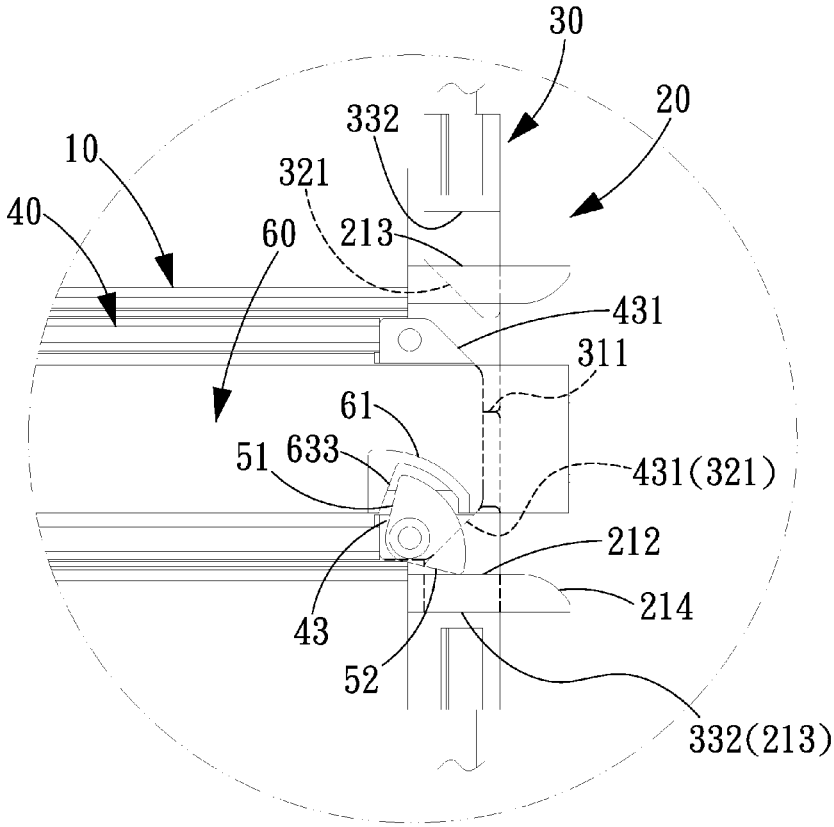
FIG. 4 is an enlarged view of a part of FIG. 2.

The present invention will be clearer from the following description when viewed together with the accompanying drawings, which show, for purpose of illustrations only, the preferred embodiment in accordance with the present invention.

Referring to FIGS. 1-5, an interlocking device for a drawer slide in accordance with a preferred embodiment of the present invention is applied in a cabinet (not shown) which comprises a plurality of drawers (not shown). Each of the drawers is provided with an interlocking device with respect to the cabinet, the interlocking devices are horizontally arranged and each two neighboring interlocking devices are connected by a connecting rod 70. Each of the interlocking devices includes an outer board 10, a fixed seat 20, two linkage members 30, a middle board 40, a restricting member 50 and an inner board 60.

The outer board 10 is elongated and fixed in a cabinet (not shown) and includes a first end 101, a second end 102 and an elongated groove 11 connected between the first and second ends 101, 102. The direction from the first end 101 to the second end 102 is defined as an X direction, and a Y direction is perpendicular to the X direction. The outer board 10 is provided with two lateral edges 12 at both sides of the elongated groove 11 and an assembling portion 13 at the first end 101.

The fixed seat 20 is an elongated hollow structure which is thick at both ends and thin in the middle and disposed at the assembling portion 13 of the outer board 10. The fixed seat 20 is formed at both ends thereof with two symmetrical receiving portions 21 and a connecting portion 22 between the two receiving portions 21. Each of the receiving portions 21 is formed with an assembling notch 211 extending in the Y direction. The connecting portion 22 is provided at both sides thereof with two rib portions 221 extending in the Y direction, and a receiving space 23 is defined between the two rib portions 221 and in communication with the two assembling notches 211. At the conjunction between the receiving portions 21 of the fixed seat 20 and the connecting portion 22 are formed a guiding surface 212 located close to the second end 102 of the outer board 10 and an arc-shaped surface 214 located close to the first end 101 of the outer board 10.

The assembling portion 13 of the outer board 10 is formed with two positioning holes 131. Between the two rib portions 221 of the connecting portion 22 of the fixed seat 20 is arranged a guiding block 222, and in the guiding block 222 are formed two holes 223. Two fixing members 24 are inserted through the holes 223 of the guiding block 222 and into the positioning holes 131 of the outer board 10, so as to fix the fixed seat 20 to the assembling portion 13 of the outer board 10.

Each of the two linkage members 30 is provided with a pushing portion 31, a guiding portion 32 and an assembling portion 33 that are arranged in a stepped manner that the guiding portion 32 is lower than the assembling portion 33 and higher than the pushing portion 31. As shown in FIG. 1, at the end of the pushing portion 31 of the respective linkage members 30 is formed a pushing edge 311, the guiding portion 32 includes an inclined surface 321 which is perpendicular and adjacent to the pushing portion 31. The assembling portion 33 is formed with a groove 331. The pushing portion 31 and the guiding portion 32 of the two linkage members 30 are inserted into the fixed seat 20 via the assembling notches 211 of the two receiving portions 21 of the fixed seat 20 in such a manner that the distance between the two inclined surfaces 321 of the two linkage members 30 tapers toward the first end 101 of the outer board 10.

In this embodiment, around each of the assembling notches 211 of the receiving portions 21 of the fixed seat 20 is formed a stopping surface 213. Between the assembling portion 33 and the guiding portion 32 of the respective linkage members 30 is connected an abutting surface 332. The pushing edges 311 of the two linkage members 30 are abutted against each other in such a manner that one of the linkage members 30 has the abutting surface 332 of the assembling portion 33 abutted against the stopping surface 213 of one of the assembling notches 211 and has the inclined surface 321 of its guiding portion 32 received in the receiving space 23 to push against the other linkage member 30, so as to make the assembling portion 33 of the other linkage member 30 disengage from its corresponding assembling notch 211. The inclined surface 321 of the guiding portion 32 of the other linkage member 30 is received in the corresponding assembling notch 211.

The middle board 40 is elongated and received in the elongated groove 11 of the outer board 10. The middle board 40 is formed with an elongated groove 41 extending in the X direction and two lateral edges 42 at both sides of the elongated groove 41. The middle board 40 is provided at one end thereof with an actuating block 43 located corresponding to the first end 101 of the outer board 10. At the end of the actuating block 43 are formed two inclined guiding surfaces 431, and the distance between the two inclined guiding surfaces 431 tapers toward the first end 101 of the outer board 10. The actuating block 43 is provided with a pivot portion 432 located adjacent to one of the lateral edges 42 of the elongated groove 41. The actuating block 43 of the middle board 40 is disposed between the two receiving portions 21 of the fixed seat 20, the height of the two inclined guiding surfaces 431 is equal to that of the inclined surfaces 321 of the two guiding portions 32 of the linkage members 30, and the distance between the inclined surfaces 321 of the two linkage members 30 is bigger than the distance between the two inclined guiding surfaces 431 of the actuating block 43.

Figure 8:
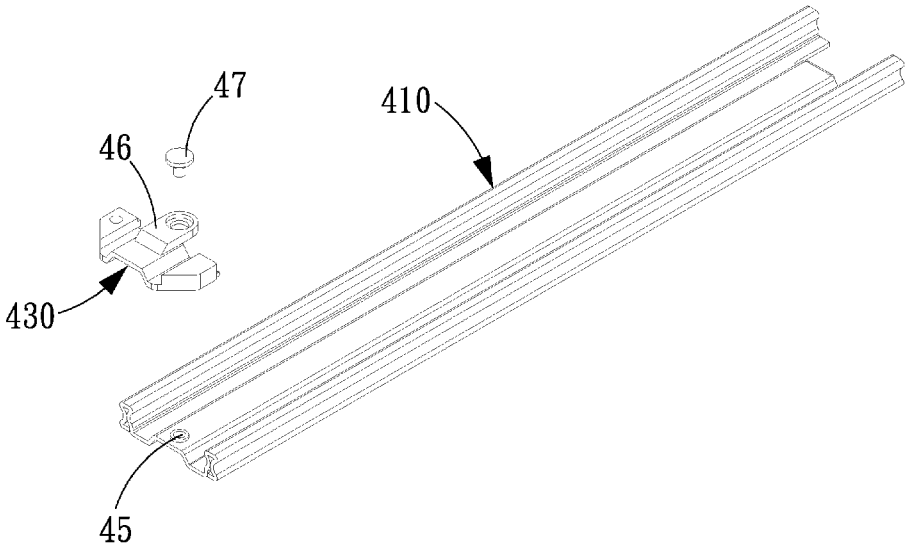
FIG. 8 shows another embodiment of the middle board of the interlocking in accordance with the present invention.

A surface of the middle board 40 opposite the bottom surface of the elongated groove 41 is formed a guiding groove 44 extending in the X direction. The guiding block 222 of the fixed seat 20 is slidably disposed in the guiding groove 44. As shown in FIG. 8, the middle board 40 comprises a board 410 and an actuating member 430 fixed to the board 410. The board 410 is formed at one end thereof with a fixing hole 45, the actuating member 430 is formed with a connecting portion 46, and then a fastener 47 is inserted through the connecting portion 46 of the actuating member 430 and into the fixing hole 45 of the board 410, so as to fix the actuating member 430 to the board 410.

The restricting member 50 is formed around its periphery with a stopping surface 51, a restricting surface 52 adjacent to the stopping surface 51 and a pivot portion 53 at the conjunction between the stopping surface 51 and the restricting surface 52. The pivot portion 53 of the restricting member 50 is pivoted to the pivot portion 432 of the actuating block 43 of the middle board 40 in such a manner that the restricting surface 52 is stopped against the receiving portion 21 of the fixed seat 20. The pivot portions 53 and 432 of the restricting member 50 and the actuating block 43 are in the form of a hole, and then a pivot 531 is inserted through the two pivot portions 53, 432 to pivot the restricting member 50 to the actuating block 43. In this embodiment, when the restricting member 50 moves in the X direction, the restricting surface 52 is abutted against the guiding surface 212, and when the restricting member 50 pivots, the restricting surface 52 is abutted against the arc-shaped surface 214.

The inner board 60 is elongated and received in the elongated groove 41 of the middle board 40 and then fixed to a drawer of the cabinet. The inner board 60 is formed with a notch 61 in the shape of the restricting member 50 and includes a pushing surface 611 for pushing against the stopping surface 51 of the restricting member 50. In this embodiment, the restricting member 50 is sectorial-shaped and includes an arc-shaped surface 54 connecting the stopping surface 51 and the restricting surface 52 for allowing the restricting member 50 to be rotated into or out of the notch 61 of the inner board 60. The notch 61 of the inner board 60 is further provided with a stopping member 63 which includes a notch 631 and a connecting portion 632. The connecting portion 632 of the stopping member 63 is inserted in the notch 61 of the inner board 60. The notch 631 is formed with an abutting surface 633 corresponding to the pushing surface 611 of the notch 61. When the restricting member 50 is restricted in notch 631, the stopping surface 51 of the restricting member 50 is pressed against the abutting surface 633.

Between every two neighboring interlocking devices is connected a connecting rod 70 which has one end connected in the grooves 331 of the two interlocking devices.

Figure 5:
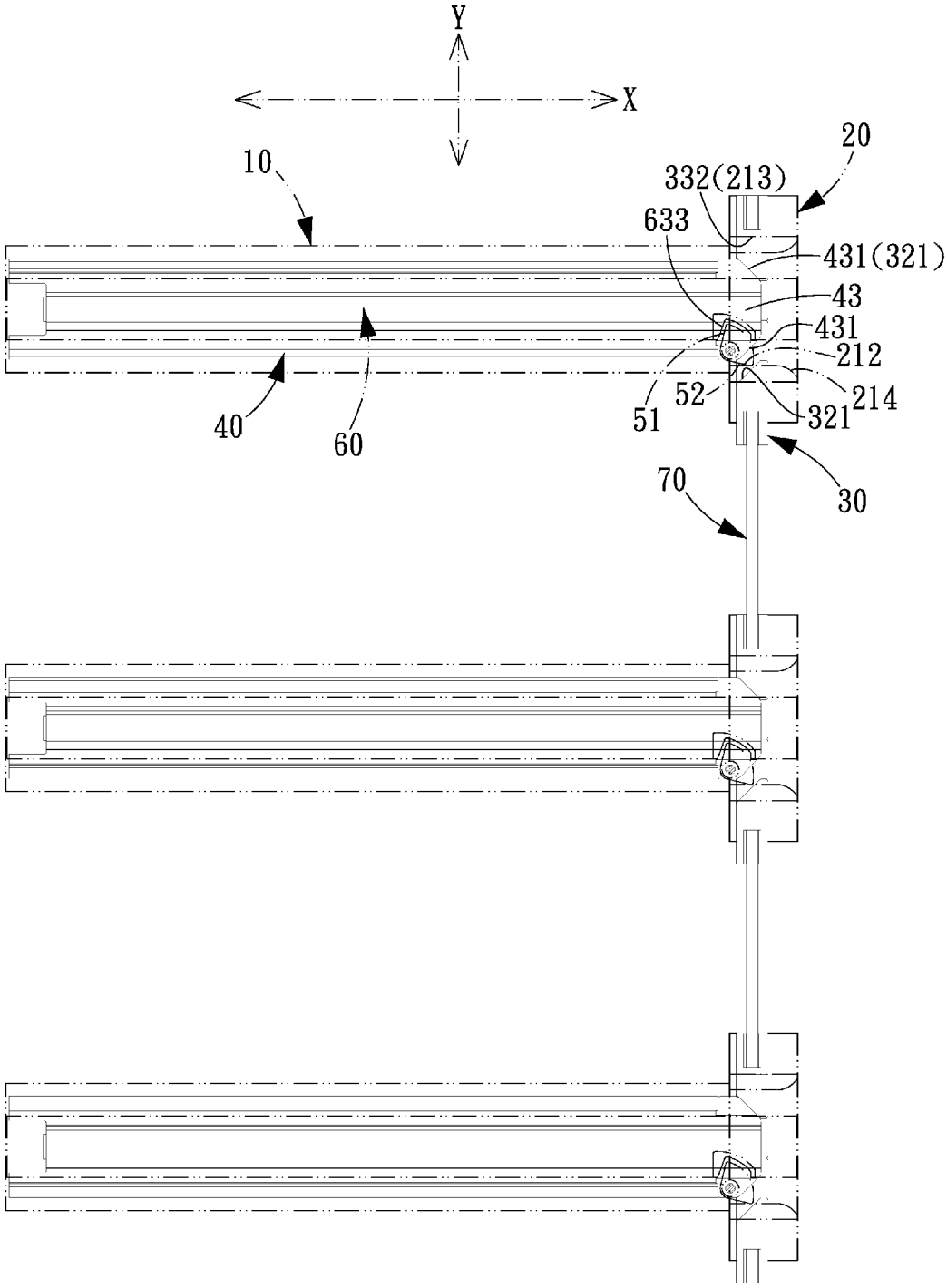
FIG. 5 shows the state of the respective interlocking devices of the present invention when none of the drawers of the cabinet is pulled out.
Figure 6:
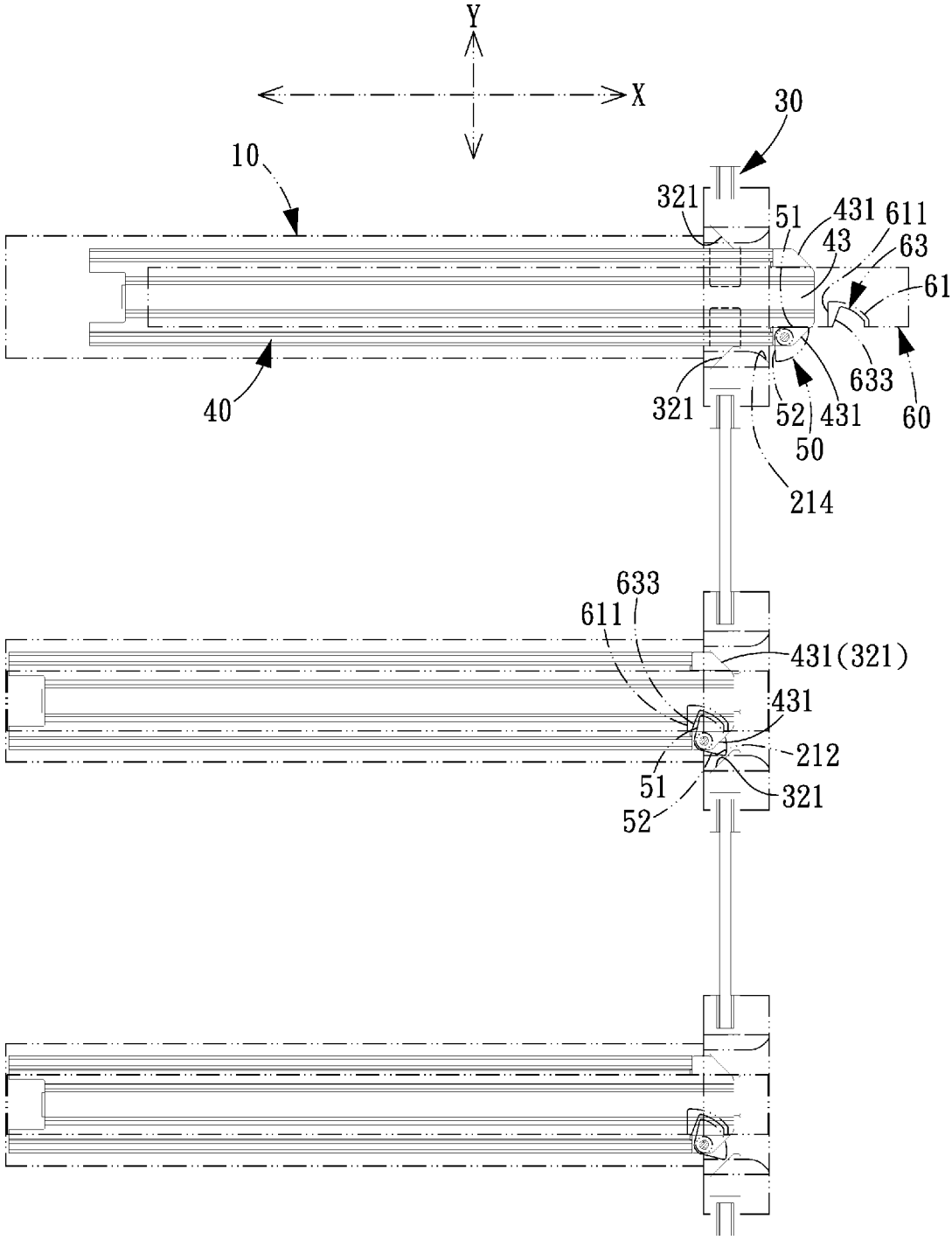
FIG. 6 shows the state of the respective interlocking devices of the present invention when the topmost drawer of the cabinet is pulled out.
Figure 7:
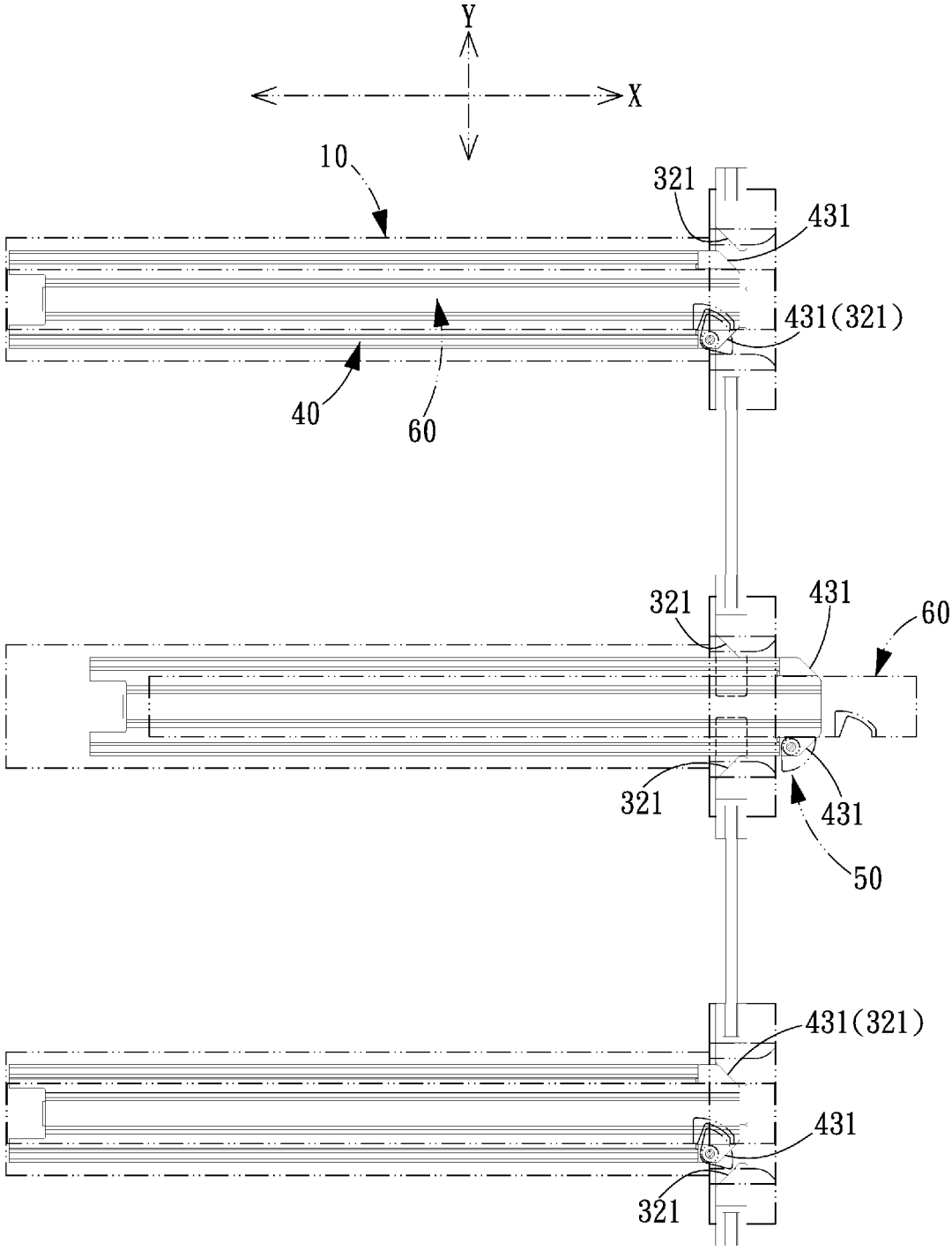
FIG. 7 shows the state of the respective interlocking devices of the present invention when the middle drawer of the cabinet is pulled out.

The main components of the present invention and structural relations thereof are described above, and for a better understanding of the operation and function of the present invention, reference should be made to FIGS. 5-7 which show that three interlocking devices. The upper interlocking device shown in FIGS. 5-7 is located at the top of the cabinet, and the lower interlocking device is located at the bottom of the cabinet.

FIG. 5 shows the state of the respective interlocking devices when none of the drawers of the cabinet is pulled out, wherein the inner board 60 and the middle board 40 are received in the outer board 10, the restricting member 50 is inserted in the notch 61 of the inner board 60, the restricting surface 52 is abutted against the guiding surface 212 of the receiving portion 21 of the fixed seat 20, and the two inclined guiding surfaces 431 of the actuating block 43 of the middle board 40 are abutted against the inclined surfaces 321 of the two linkage members 30. The linkage members 30 and the connecting rods 70 move downward to the bottom of the cabinet because of gravity, so that the inclined surface 321 of the upper linkage member 30 will be abutted against the upper inclined guiding surface 431 of the actuating block 43, and the inclined surface 321 of the lower linkage member 30 will move away from the lower inclined guiding surface 431 of the actuating block 43.

As shown in FIGS. 6 and 7, pulling one of the drawers in the X direction drive the inner board 60 to move, since the restricting surface 52 of the restricting member 50 is restricted by the fixed seat 20 and unable to rotate, so that the pushing surface 611 of the notch 61 of the inner board 60 will push the stopping surface 51 of the restricting member 50, consequently making the middle board 40 slide. Then the actuating block 43 will use its inclined guiding surface 431 to push the inclined surface 321 of the upper linkage member 30, so that the upper linkage member 30 will be pushed to move upward, and finally the guiding portion 32 of the two linkage members 30 will be pushed into the receiving portions 21 of the fixed seat 20 by the lateral edge 42.

As shown in FIG. 6, when the topmost drawer in the cabinet is being pulled, the lower linkage member 30 of the interlocking device of this drawer will use the connecting rod 70 to push the linkage members 30 of other interlocking devices, so as to make the inclined surface 321 of the guiding portion 32 of the upper linkage member 30 of other interlocking devices abut against the upper inclined guiding surface 431 of the actuating block 43. Hence, the middle board 40 is stopped from sliding, and other drawers cannot be pulled out. As shown in FIG. 7, when the middle drawer in the cabinet is being pulled, the two linkage members 30 of the interlocking device of the middle drawer will move upward and downward, respectively, to push the connecting rods 70, so that the lower linkage member 30 of the topmost interlocking device will be pushed against its actuating block 43, and the upper linkage member 30 of the lowermost interlocking device will also be pushed against its actuating block 43. When the inner board 60 keeps pushing the restricting member 50 to make the middle board 40 slide until the restricting member 50 is pushed out of and is not restricted by the outer board 10 anymore, the restricting member 50 will be pivoted to make the inner board 60 move out of the outer board 10 along with the movement of the drawer being pulled.

Figure 9:
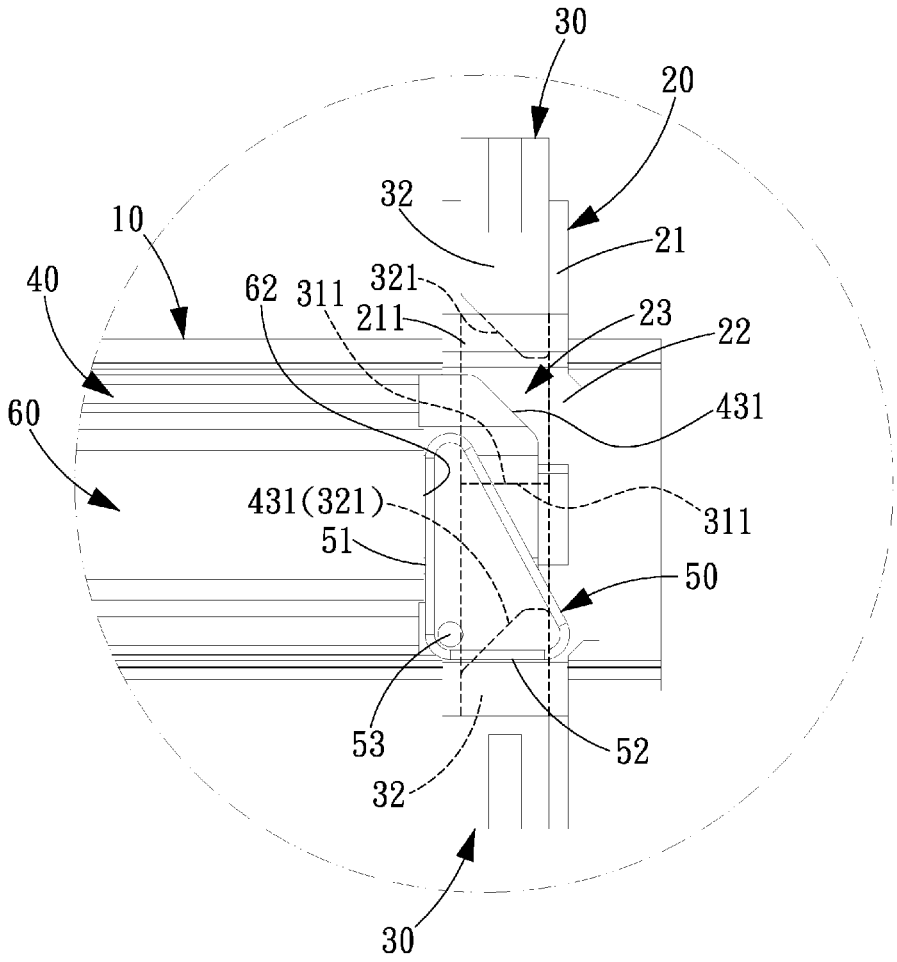
FIG. 9 shows another embodiment of the inner board and the restricting member of FIG. 4.
Figure 10:
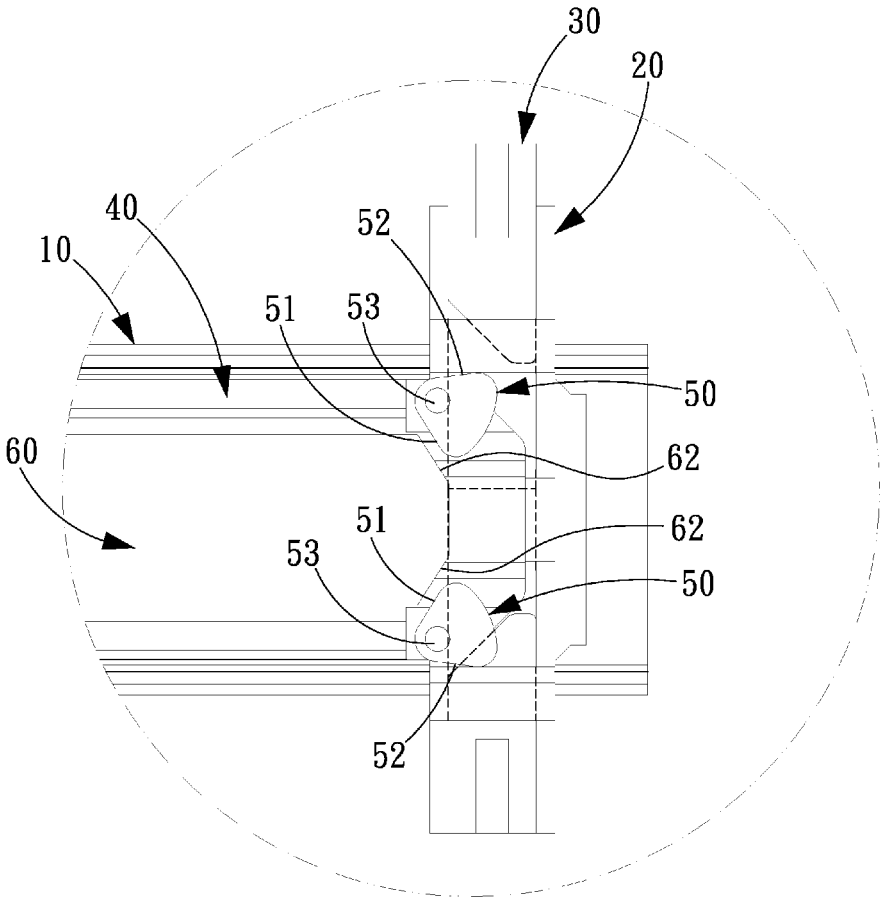
FIG. 10 shows yet another embodiment of the inner board and the restricting member of FIG. 4.
Figure 11:
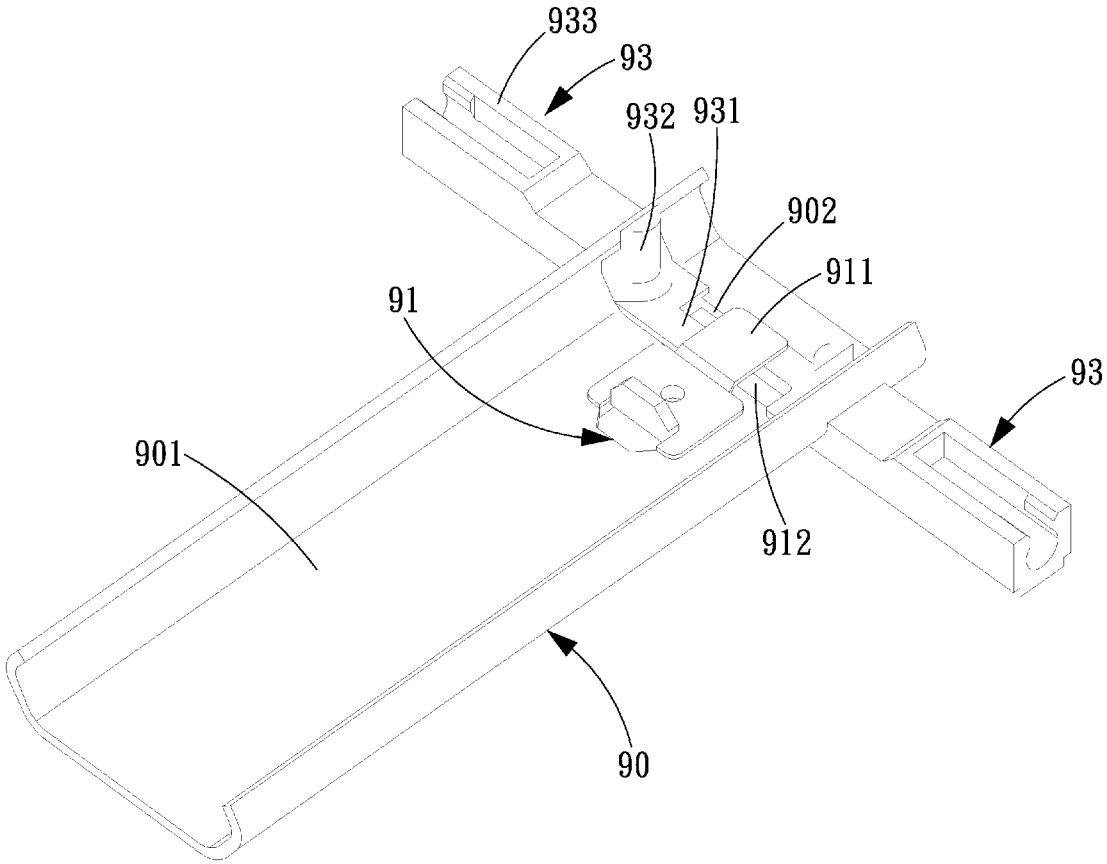
FIG. 11 PRIOR ART
FIG. 11 shows a conventional interlocking device for a drawer slide.
Figure 12:
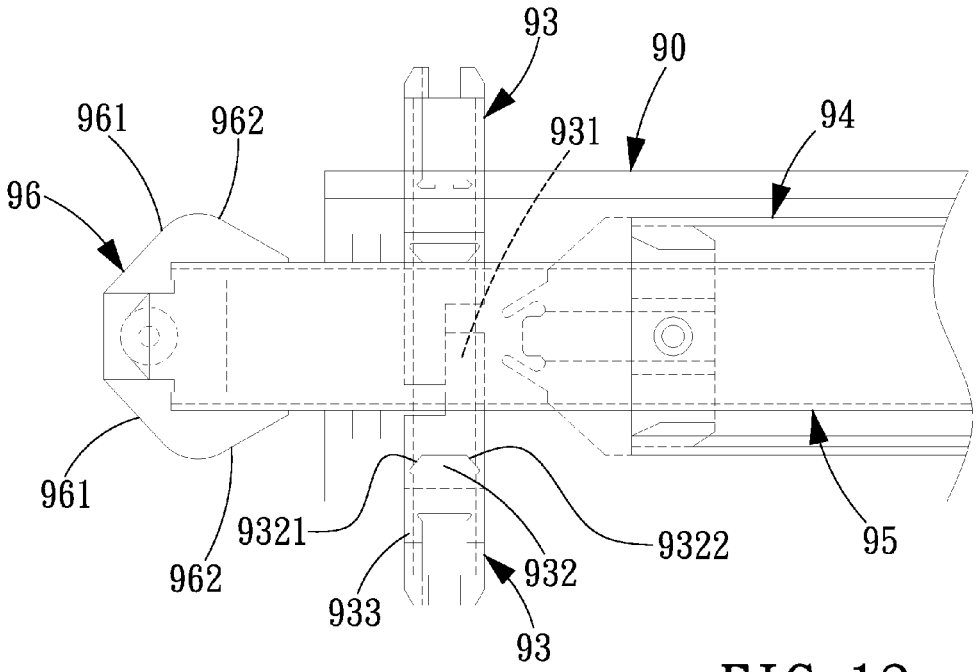
FIG. 12 PRIOR ART
FIG. 12 is another view of the conventional interlocking device for a drawer slide.
Figure 13:
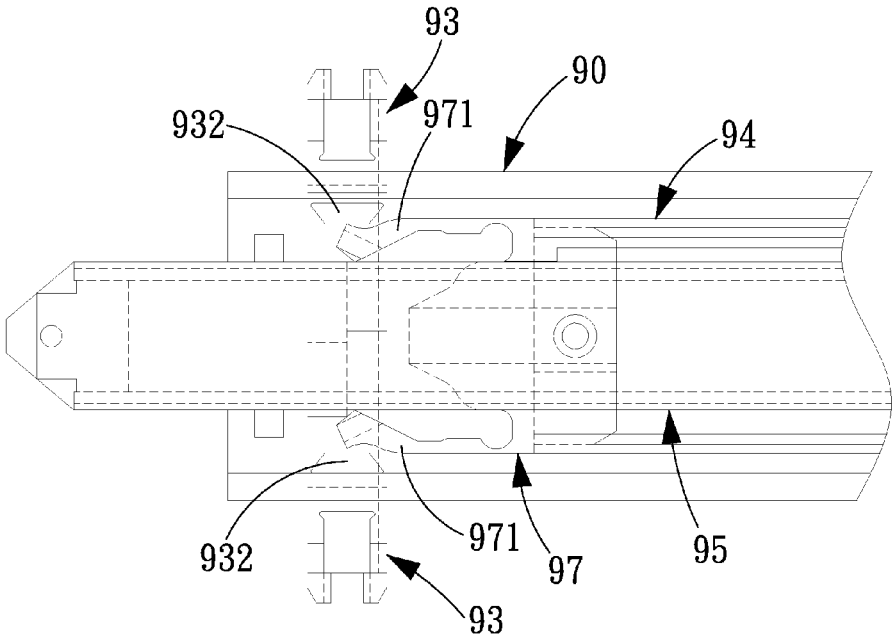
FIG. 13 PRIOR ART
FIG. 13 is yet another view of the conventional interlocking device for a drawer slide.

FIGS. 9 and 10 show another embodiment of the inner board 60 and the restricting member 50. As shown in FIG. 9, the inner board 60 is provided at its end with a pressing surface 62 for pushing the middle board 40 to slide by pushing against the stopping surface 51 of the restricting member 50. As shown in FIG. 10, the end of the inner board 60 is cut to form two inclined pressing surfaces 62, and the interlocking device is provided with two restricting members 50 which are disposed at both sides of the actuating block 43 of the middle board 40. The stopping surfaces 51 of the respective restricting members 50 are equal in height to the two pressing surfaces 62 of the inner board 60, and the restricting surfaces 52 of the respective restricting members 50 are stopped against the lateral edges 12 of the outer board 10.

It is clear from the above description that the interlocking device of the present invention provides strong structure strength to the linkage member 30 and can maintain other drawers in a locked state when one drawer is being pulled. Furthermore, since the middle board 40 is driven to slide by the inner board 60, when the drawer is being closed, the middle board 40 and the inner board 60 can be pushed back synchronously, reducing the noise caused when the drawer slide is returning.

While we have shown and described various embodiments in accordance with the present invention, it is clear to those skilled in the art that further embodiments may be made without departing from the scope of the present invention.

What is claimed is:

1. An interlocking device for a drawer slide being applied in a cabinet which comprises a plurality of drawers, each of the drawers being provided with an interlocking device with respect to the cabinet, the interlocking devices being horizontally arranged and each two neighboring interlocking devices are connected by a connecting rod, the interlocking device comprising:

an elongated outer board fixed in the cabinet and including a first end, a second end and an elongated groove connected between the first and second ends a direction from the first end to the second end being defined as an X direction, and a Y direction being perpendicular to the X direction, the outer board being provided with an assembling portion at the first end;

a fixed seat being disposed at the assembling portion of the outer board and formed at both ends thereof with two receiving portions and a connecting portion between the two receiving portions, each of the receiving portions being formed with an assembling notch extending in the Y direction, the connecting portion being provided at both sides thereof with two rib portions extending in the Y direction, and a receiving space being defined between the two rib portions and in communication with the two assembling notches;

two linkage members each provided with a pushing portion, a guiding portion and an assembling portion that are arranged in a stepped manner that the guiding portion is lower than the assembling portion and higher than the pushing portion, at an end of the pushing portion of the respective linkage members being formed a pushing edge, the guiding portion including an inclined surface which is perpendicular and adjacent to the pushing portion, the assembling portion being formed with a groove, the pushing portion and the guiding portion of the two linkage members being inserted into the fixed seat via the assembling notches of the two receiving portions of the fixed seat in such a manner that a distance between the two inclined surfaces of the two linkage members tapers toward the first end of the outer board, the pushing edges of the two linkage members being abutted against each other in such a manner that one of the linkage members has the inclined surface of its guiding portion received in the receiving space, so as to make the assembling portion of the other linkage member disengage from its corresponding assembling notch, the inclined surface of the guiding portion of the other linkage member is received in the corresponding assembling notch;

an elongated middle board received in the elongated groove of the outer board and formed with an elongated groove extending in the X direction and two lateral edges at both sides of the elongated groove, the middle board being provided at one end thereof with an actuating block located corresponding to the first end of the outer board, at one end of the actuating block being formed two inclined guiding surfaces, and the distance between the two inclined guiding surfaces tapers toward the first end of the outer board, the actuating block being provided with a pivot portion located adjacent to one of the lateral edges of the elongated groove, the actuating block of the middle board being disposed between the two receiving portions of the fixed seat, a height of the two inclined guiding surfaces being equal to that of the inclined surfaces of the two guiding portions of the linkage members, and a distance between the inclined surfaces of the two linkage members being bigger than a distance between the two inclined guiding surfaces of the actuating block;

a restricting member being formed around its periphery with a stopping surface, a restricting surface adjacent to the stopping surface and a pivot portion at a conjunction between the stopping surface and the restricting surface, the pivot portion of the restricting member being pivoted to the pivot portion of the actuating block of the middle board in such a manner that the restricting surface is stopped against one of the receiving portions of the fixed seat;

an elongated inner board received in the elongated groove of the middle board and then fixed to a drawer of the cabinet, the inner board being formed with a notch in the shape of the restricting member and including a pushing surface for pushing against the stopping surface of the restricting member; and the respective connecting rods having two ends inserted and connected to the grooves of the linkage members and are arranged in the Y direction, the drawers being arranged in the Y direction, when one of the drawers is pulled in the X direction toward the first end of the outer board, the inner board will be moved together with the drawer being pulled and push the restricting member, the middle board and the actuating block, then the two linkage members are pushed to move in an opposite direction to the Y direction, as a result, the connecting rods are caused to push the linkage members of other interlocking devices, so that the inclined surface of the guiding portion of one of the linkage members of other interlocking devices will be received in the receiving space and abutted against the inclined guiding surface of the actuating block of the middle board of the other interlocking devices to prevent other drawers from being pulled out.

2. The interlocking device for a drawer slide as being claimed in claim 1, wherein a stopping surface is formed around each of the assembling notches of the receiving portions of the fixed seat, between the assembling portion and the guiding portion of the respective linkage members is connected an abutting surface.

3. The interlocking device for a drawer slide as being claimed in claim 1, wherein between the two rib portions of the connecting portion of the fixed seat is arranged a guiding block, a surface of the middle board opposite the bottom surface of the elongated groove is formed a guiding groove extending in the X direction, the guiding block of the fixed seat is slidably disposed in the guiding groove.

4. The interlocking device for a drawer slide as being claimed in claim 1, wherein the assembling portion of the outer board is formed with two positioning holes, between the two rib portions of the connecting portion of the fixed seat is arranged a guiding block, and in the guiding block are formed two holes, two fixing members are inserted through the holes of the guiding block and into the positioning holes of the outer board, so as to fix the fixed seat to the assembling portion of the outer board.

5. The interlocking device for a drawer slide as being claimed in claim 1, wherein a pivot is inserted through the two pivot portions to pivot the restricting member to the actuating block.

6. The interlocking device for a drawer slide as being claimed in claim 1, wherein at a conjunction between the receiving portions of the fixed seat and the connecting portion are formed a guiding surface located close to the second end of the outer board and an arc-shaped surface located close to the first end of the outer board, when the restricting member moves in the X direction, the restricting surface is abutted against the guiding surface of the receiving portion of the fixed seat, when the restricting member pivots, the restricting surface is abutted against the arc-shaped surface.

7. The interlocking device for a drawer slide as being claimed in claim 1, wherein the notch of the inner board is further provided with a stopping member which includes a notch and a connecting portion, the connecting portion of the stopping member is inserted in the notch of the inner board, the notch of the stopping member is formed with an abutting surface corresponding to the pushing surface of the notch of the inner board, and the stopping surface of the restricting member is pressed against the abutting surface.

8. An interlocking device for a drawer slide being applied in a cabinet which comprises a plurality of drawers, each of the drawers being provided with an interlocking device with respect to the cabinet, the interlocking devices being horizontally arranged and each two neighboring interlocking devices are connected by a connecting rod, the interlocking device comprising:

an elongated outer board fixed in the cabinet and including a first end, a second end and an elongated groove connected between the first and second ends a direction from the first end to the second end being defined as an X direction, and a Y direction being perpendicular to the X direction, the outer board being provided with an assembling portion at the first end;

a fixed seat being disposed at the assembling portion of the outer board and formed at both ends thereof with two receiving portions and a connecting portion between the two receiving portions, each of the receiving portions being formed with an assembling notch extending in the Y direction, the connecting portion being provided at both sides thereof with two rib portions extending in the Y direction, and a receiving space being defined between the two rib portions and in communication with the two assembling notches;

two linkage members each provided with a pushing portion, a guiding portion and an assembling portion that are arranged in a stepped manner that the guiding portion is lower than the assembling portion and higher than the pushing portion, at an end of the pushing portion of the respective linkage members being formed a pushing edge, the guiding portion including an inclined surface which is perpendicular and adjacent to the pushing portion, the assembling portion being formed with a groove, the pushing portion and the guiding portion of the two linkage members being inserted into the fixed seat via the assembling notches of the two receiving portions of the fixed seat in such a manner that a distance between the two inclined surfaces of the two linkage members tapers toward the first end of the outer board, the pushing edges of the two linkage members being abutted against each other in such a manner that one of the linkage members has the inclined surface of its guiding portion received in the receiving space, so as to make the assembling portion of the other linkage member disengage from its corresponding assembling notch, the inclined surface of the guiding portion of the other linkage member is received in the corresponding assembling notch;

an elongated middle board received in the elongated groove of the outer board and formed with an elongated groove extending in the X direction and two lateral edges at both sides of the elongated groove, the middle board comprising a board and an actuating member fixed to the board, the board being formed at one end thereof with a fixing hole, the actuating member being formed with a connecting portion, and then a fastener being inserted through the connecting portion of the actuating member and into the fixing hole of the board, so as to fix the actuating member to the board, the actuating member being located corresponding to the first end of the outer board, at one end of the actuating member being formed two inclined guiding surfaces, and the distance between the two inclined guiding surfaces tapers toward the first end of the outer board, the actuating member being provided with a pivot portion located adjacent to one of the lateral edges of the elongated groove, the actuating member of the middle board being disposed between the two receiving portions of the fixed seat, a height of the two inclined guiding surfaces being equal to that of the inclined surfaces of the two guiding portions of the linkage members, and a distance between the inclined surfaces of the two linkage members being bigger than a distance between the two inclined guiding surfaces of the actuating member;

a restricting member being formed around its periphery with a stopping surface, a restricting surface adjacent to the stopping surface and a pivot portion at a conjunction between the stopping surface and the restricting surface, the pivot portion of the restricting member being pivoted to the pivot portion of the actuating member of the middle board in such a manner that the restricting surface is stopped against one of the receiving portions of the fixed seat;

an elongated inner board received in the elongated groove of the middle board and then fixed to a drawer of the cabinet, the inner board being formed with a notch in the shape of the restricting member and including a pushing surface for pushing against the stopping surface of the restricting member; and the respective connecting rods having two ends inserted and connected to the grooves of the linkage members and are arranged in the Y direction, the drawers being arranged in the Y direction, when one of the drawers is pulled in the X direction toward the first end of the outer board, the inner board will be moved together with the drawer being pulled and push the restricting member, the middle board and the actuating member, then the two linkage members are pushed to move in an opposite direction to the Y direction, as a result, the connecting rods are caused to push the linkage members of other interlocking devices, so that the inclined surface of the guiding portion of one of the linkage members of other interlocking devices will be received in the receiving space and abutted against the inclined guiding surface of the actuating member of the middle board of the other interlocking devices to prevent other drawers from being pulled out.

* * * * *